US005505232A

United States Patent [19]

Barclay

[11] Patent Number: 5,505,232

[45] Date of Patent: Apr. 9, 1996

[54] INTEGRATED REFUELING SYSTEM FOR VEHICLES

[75] Inventor: John A. Barclay, Victoria, Canada

[73] Assignee: CryoFuel Systems, Inc., Federal Way, Wash.

[21] Appl. No.: 140,732

[22] Filed: Oct. 20, 1993

[51] Int. Cl.[6] ..... B65B 1/20

[52] U.S. Cl. ..... 141/11; 141/82; 123/525; 123/527; 62/50.2

[58] Field of Search ..... 141/11, 82, 285; 123/525, 527; 62/7, 9, 48.2, 50.2, 50.4, 53.2

[56] References Cited

U.S. PATENT DOCUMENTS

| | | | |
|---|---|---|---|
| 2,090,163 | 9/1937 | Twomey | 62/175 |
| 2,500,118 | 3/1950 | Cooper | 62/175.5 |
| 2,509,034 | 5/1950 | Claitor et al. | 62/123 |
| 2,524,397 | 10/1950 | Roberts et al. | 62/175.5 |
| 2,541,569 | 2/1951 | Born et al. | 62/122 |
| 2,550,886 | 5/1951 | Thompson | 62/1 |
| 2,682,154 | 6/1954 | Wilkinson | 62/1 |
| 2,705,406 | 4/1955 | Morrison | 62/123 |
| 2,712,730 | 7/1955 | Spangler | 62/1 |
| 3,237,421 | 3/1966 | Gifford | 62/88 |
| 3,616,652 | 11/1971 | Engel | 62/9 |
| 3,672,180 | 6/1972 | Davis | 62/54 |
| 3,733,838 | 5/1973 | Delahunty | 62/48.2 |
| 3,802,213 | 4/1974 | Ooka | 62/55 |
| 3,827,247 | 8/1974 | Kojima et al. | 62/50.2 |
| 3,878,689 | 4/1975 | Grenci | 62/9 |
| 3,886,759 | 6/1975 | McNamee | 62/54 |
| 4,231,418 | 11/1980 | Lagodmos | 165/4 |
| 4,334,902 | 6/1982 | Paradowski | 62/9 |
| 4,359,872 | 11/1982 | Goldowsky | 62/6 |
| 4,879,876 | 11/1989 | Robertson | 62/6 |
| 4,953,366 | 9/1990 | Swift et al. | 62/467 |
| 5,107,683 | 4/1992 | Chan et al. | 62/6 |
| 5,107,906 | 4/1992 | Swenson et al. | 62/50.2 |
| 5,121,609 | 6/1992 | Cieslukowski | 123/525 |
| 5,127,230 | 7/1992 | Neeser | 62/7 |
| 5,172,554 | 12/1992 | Swift et al. | 62/6 |
| 5,315,831 | 5/1994 | Goode et al. | 62/50.2 |

FOREIGN PATENT DOCUMENTS

| | | |
|---|---|---|
| 53-14410 | 9/1978 | Japan . |
| 3-286967 | 12/1991 | Japan . |

*Primary Examiner*—Henry J. Recla
*Assistant Examiner*—Steven O. Douglas
*Attorney, Agent, or Firm*—Foster & Foster; L. Grant Foster

[57] ABSTRACT

An integrated refueling system comprises a fluid circuit including multiple flow paths for directing natural gas to a natural gas liquefier. A portion of the resulting liquefied natural gas is provided to a liquefied natural gas delivery location. Another portion of the liquefied natural gas may be provided to a compressor and subsequently a heat exchanger/vaporizer to produce compressed natural gas. The heat exchanger/vaporizer may utilize the lower temperature of liquefied natural gas to precool incoming gaseous natural gas while simultaneously vaporizing the pressurized, liquefied natural gas to form the compressed natural gas. Compressed natural gas may be provided at a compressed natural gas delivery location.

34 Claims, 2 Drawing Sheets

INTEGRATED REFUELING SYSTEM FOR VEHICLES

TECHNICAL FIELD

This invention relates to integrated systems for providing fuel to vehicles, and, more particularly, to systems for providing compressed natural gas and liquefied natural gas in an integrated manner at refueling stations for vehicles.

BACKGROUND OF THE INVENTION

Most vehicles utilize gasoline or diesel as fuels. There are, however, several well-known problems associated with using gasoline and diesel as fuels for vehicles. Many of these problems are associated with the emissions from combustion which contribute to unhealthy air pollution, global warming, and acid rain.

Another problem concerning gasoline and diesel as fuels for vehicles relates to the unequitable world-wide distribution of oil resources. Many countries rely heavily, if not completely, on the importation of oil to meet their demands for gasoline or diesel fuel.

Because of the well-known problems associated with gasoline and diesel as fuels for vehicles, much effort has gone into developing alternative fuels for vehicles in recent years. Natural gas is recognized as an alternative fuel to gasoline or diesel for vehicles. Natural gas has many advantages over gasoline or diesel as a vehicle fuel. Perhaps most importantly, natural gas burns much cleaner than gasoline or diesel fuel. It is also much less expensive than gasoline or diesel fuel for an equivalent energy content. Further, natural gas is safer because it rises and dissipates into the air, rather than settling like gasoline or diesel fuel. There are also engine performance benefits from using natural gas as a fuel. Natural gas has a higher octane as compared to gasoline, which will result in improved "cold starting" of vehicles.

To be used as an alternative fuel source for vehicles, natural gas is conventionally converted into compressed natural gas (CNG) or liquefied natural gas (LNG) in order to be able to store natural gas efficiently on board the vehicle. A variety of methods have been developed over the years to create CNG or LNG. Such known systems have traditionally been developed exclusive of one another. There remains a need to develop an improved system for producing both LNG and CNG and economically providing both LNG and CNG in an integrated fashion to a vehicle refueling station.

A primary barrier to using natural gas as a transportation fuel is the lack of a cost-effective refueling infrastructure. Although an abundance of natural gas network distribution lines exist in most geographic regions, no suitable system has heretofore been developed for converting low-pressure natural gas available through this distribution network into LNG and/or CNG, or a refueling infrastructure for providing LNG and/or CNG to end users. Traditional natural gas refueling systems commonly require the natural gas to be hauled in tanker trucks in a liquefied or compressed form.

The present invention involves an integrated refueling system for supplying LNG and CNG at vehicle refueling stations. The various objects, features and advantages of the invention will become apparent from the detailed description of the invention that follows.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
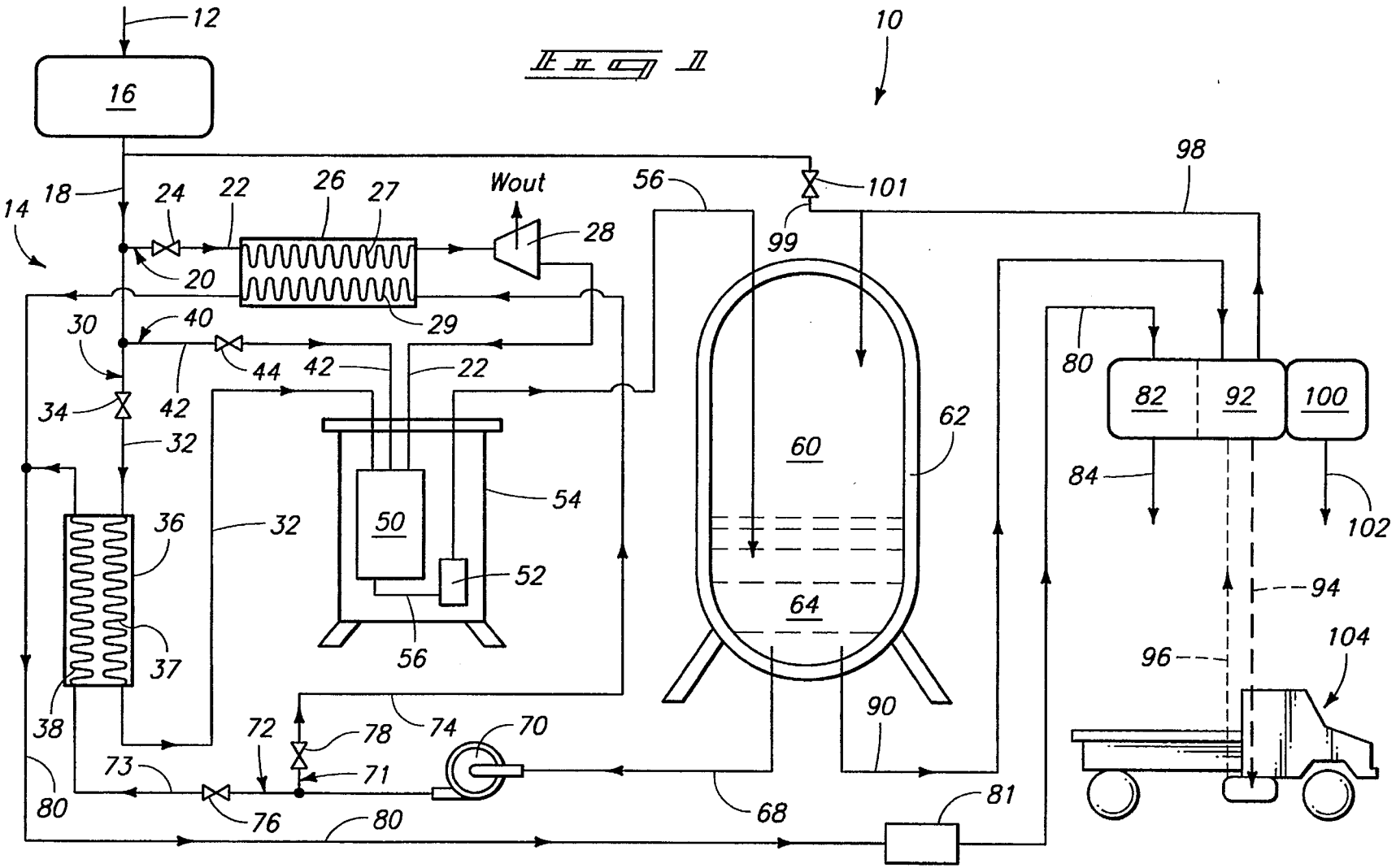
FIG. 1 is schematic view of a system for manufacturing and providing liquefied natural gas and compressed natural gas in an integrated manner at a vehicle refueling station.

FIG. 1 generally shows an integrated refueling system 10 for producing and supplying compressed natural gas (CNG) and liquefied natural gas (LNG) at a vehicle refueling station. The CNG and LNG are intended to be produced from natural gas supplied in a typical, existing residential/commercial distribution network for natural gas.

The refueling system 10 comprises an inlet 12 for supplying natural gas to a fluid circuit 14. The natural gas flowing from inlet 12 passes through a regenerative purifier system 16, which will be discussed in greater detail below. Natural gas from the regenerative purifier 16 is supplied via line 18 to either a first flow path 20, a second flow path 30, or third flow path 40 depending upon either the characteristics of the incoming natural gas (e.g., the pressure of the natural gas) and/or the desired natural gas product (e.g., whether LNG or CNG, or both, will be produced).

When the pressure of natural gas entering into the fluid circuit 14 exceeds a normal pressure range of natural gas in existing residential/commercial lines (e.g., approximately 2 to 4 psig at the burner), the natural gas from inlet 18 is directed through the first flow path 20. Flow path 20 can be used when the production of LNG, alone, is desired, where both LNG and CNG are to be produced, or when only CNG is to be produced. The first flow path comprises a first flow line 22 serially and fluidly coupled to a first flow control valve 24, a first heat exchanger/vaporizer 26, and an expander 28. The flow of natural gas through the first flow line is regulated by pressure regulator 24. The lines from the heat exchanger 27 and the expander 28 to the liquefier 50 will be insulated by normal means as will other lines in the system that carry cold gas or LNG. The first flow line terminates at liquefier 50.

The natural gas passes through a forward flow passageway 27 of the first heat exchanger/vaporizer 26 where it is precooled by a countercurrent flow of relatively cooler pressurized liquefied natural gas passing through countercurrent passageway 29. The pressurized liquefied natural gas in passageway 29 is simultaneously vaporized by the relatively warmer natural gas in passageway 27 (discussed in greater detail below). The natural gas flows from the first heat exchanger/vaporizer 26 to the expander 28, which reduces the pressure of the natural gas and further cools the natural gas before introducing it to the liquefier 50. Some liquefaction of the natural gas may occur at the expander 28.

Natural gas is directed through the second flow path 30 normally when production of both LNG and CNG, or only CNG, is desired, and when the pressure of the incoming natural gas falls below a useful pressure range for the expander (e.g., approximately 35 psig). The second flow path includes a second flow line 32 serially and fluidly coupled to a second heat exchanger/vaporizer 36. The second flow line 32 terminates at liquefier 50. The flow of natural gas through the second flow line 32 is regulated by a second flow control valve 34. Natural gas passes through a forward flow passageway 37 of the second heat exchanger/vaporizer 36 where it is precooled by a countercurrent of relatively cooler pressurized liquefied natural gas flowing through countercurrent passageway 38 prior to entering the liquefier 50. The pressurized liquefied natural gas flowing through passageway 38 is simultaneously vaporized from the relatively warmer flow of natural gas in passageway 37 to produce compressed natural gas (discussed below).

Natural gas is directed toward through the third flow path 40 when only LNG is desired and when the pressure of incoming natural gas falls within a normal pressure range (e.g., from approximately 2 to 4 psig up to approximately 35 psig). The third flow path 40 includes a third flow line 42 which passes directly to and terminates at the liquefier 50. The flow of natural gas within the third flow line 42 is regulated by a third flow control valve 44. The third flow path 40 directs natural gas that has been purified by the regenerative purifier system 16 directly to the liquefier 50 without any precooling.

The liquefier 50 may comprise any suitable liquefier. At least six different types of liquefiers have been identified which may work with the present invention. These liquefiers include: (1) use of a cryogen colder than the condensation temperature of natural gas (−161° C. or 111 K.) such as liquid nitrogen (which has a boiling point of 77 K.); (2) use of a cascade-cycle three-stage refrigerator; (3) use of a mixed refrigerant cycle; (4) use of a recuperative gas expander cycle such as the Claude or related cycle; (5) use of regenerative gas cycle refrigerators such as a Gifford-McMahon, Stirling, or Orifice Pulse Tube device; and (6) use of a regenerative magnetic cycle refrigerator. In addition, when the pressure of the incoming natural gas is sufficiently high (approximately 500 to 1000 psig), the use of expander 28 will produce a relatively large amount of LNG (as compared to when natural gas at relatively lower pressures is directed through an expander) and constitute an additional method of liquefaction.

The liquefier 50 cools the incoming and sometimes precooled natural gas from its entry temperature to its saturated vapor temperature (approximately 111 K.) where the natural gas condenses into a liquid. Liquefaction may occur in a single stage or through use of multi-stage refrigerators.

The liquefier 50 is disposed inside an insulated cold box 54. A buffer storage unit 52 is also disposed inside the cold box. The buffer storage vessel provides a buffer volume of LNG to compensate for differential pressures and differential supplies and demands on opposite sides of the cold box.

Liquefied natural gas passes from the liquefier 50 through line 56 and into a storage tank 62. The storage tank stores liquefied natural gas in a bottom portion 64 of the tank. Liquefied natural gas settles by way of gravity to the bottom portion 64 of storage tank 62. The tank 62 is also capable of storing and reliquefying natural gas vapors in an upper portion 60 of the tank. The natural gas vapors enter the tank and become suspended above the liquefied natural gas. The storage tank preferably will have a capacity to meet a fleet demand of approximately 1000 gallons per day, although this capacity can be substantially varied as required.

To produce CNG with the system of the present invention, LNG is drawn through line 68 by pump 70. The pump 70 compresses LNG from the storage tank 62 (approximately 35 psi) to approximately 3000 psi. The pump can also load external storage tankers and gas lines by adjusting the exhaust pressure. LNG from line 68 is supplied to either a first liquefied natural gas flow path 71 and a second liquefied natural gas flow path 72, depending upon which flow path (path 20 or 30) is used for incoming natural gas. The first liquefied natural gas flow path 71 includes a first liquefied natural gas flow line 74. The flow rate of LNG within line 74 is regulated by control valve 78. The pressurized LNG within flow line 74 passes through a counterflow passageway 28 of the first heat exchanger/vaporizer 26. The liquefied natural gas flowing within the counterflow passageway 29 is vaporized due to the heat exchange between the relatively colder LNG in the counterflow passageway 29 and the flow of relatively warmer gaseous natural gas flowing in line 27. The vaporization of the high pressure LNG produces CNG. The CNG is directed to a CNG dispenser line 80 which, in turn, leads to a CNG dispenser at a CNG dispensing location 82. The CNG may then be dispensed to vehicles via line 84. A CNG buffer tank 81 may optionally be provided between the vaporizer 26 and the dispenser 82, as desired. Such a CNG buffer tank will enable constant supply of CNG even when the demand at the dispenser exceeds the rate of CNG production.

The second liquified natural gas flow path 72 includes a second liquefied natural gas flow line 73. The flow of LNG within flow line 73 is regulated by flow control valve 76. The pressurized LNG within line 73 passes through a counterflow passageway 38 of the heat exchanger/vaporizer 36 which causes the LNG to vaporize and become warmer compressed natural gas. This occurs because of the relatively warmer forward flow of gaseous natural gas passing through the forward flow passageway 37 which causes an exchange of heat with the relatively colder LNG flowing through counterflow passageway 38. The resulting CNG is directed to the compressed natural gas dispenser line 80 which, in turn, supplies compressed natural gas to a CNG dispenser at a CNG dispensing location 82. The CNG is supplied to vehicles via line 84, and is dispensed at approximately 3000 psi. An odorant can be reinjected into the CNG upon dispensing.

One of the problems encountered during rapid dispensing of CNG into vehicle fuel tanks is the heating of residual gas in the tank which is at a pressure less than 3000 psi. This heat of compression yields an average temperature in the tank which is above room temperature when the tank pressure reaches 3000 psi. When the gas subsequently cools to ambient temperature, the tank pressure becomes less than 3000 psi, which leaves the tank less than full. This, of course, reduces the range of the vehicle. This problem is overcome in the present system by dispensing the CNG from the vaporizer into the vehicle fuel tank at a temperature cooler than room temperature so the CNG in the tank at 3000 psi is at room temperature. This is a "quick fill" process that is another beneficial aspect of the present invention.

LNG from the storage tank 62 may also be directly supplied via LNG dispenser line 90 to an LNG dispenser at a dispensing location 92. From the dispensing location 92, LNG flows through a flexible, insulated fuel line for providing fuel to a vehicle 104. LNG is dispensed to vehicles at approximately 35 psi. Incorporated within the fuel line is a boil-off gas return line 96 which captures natural gas vapors produced as the LNG cools the vehicle fuel tank and fuel dispensing line as it is dispensed into the vehicle. These vapors pass through boil-off line 96 and are directed back into the storage tank 62 via vapor return line 98 for reliquefaction. Alternatively, the vapors in boil-off line 96 can be directed via line 99 to the incoming supply line 18. Control valve 101 regulates the flow of boil-off gas to line 18. One advantage of the present invention is the ability to reliquefy the boil-off gas from dispensing operations or from normal heat leaks into the storage tank 62. Elimination of venting of natural gas will increase the safety and economics of the refueling system compared to other systems. An odorant can be contained in the LNG storage tank or injected during dispensing.

An electronic control unit (not shown) will automatically operate the entire integrated refueling system. The entire system will also include appropriate safety equipment such as gas detectors, pressure check points, temperature check points, liquefaction rate gages, liquid level gages, etc.

A primary advantage of the present refueling system invention is that it serves as an on-site system with the ability to take natural gas from a conventional supply line, which currently exist in most places, and produce LNG, CNG, or both. The system is quite small and compact relative to traditional liquefaction and compression systems for natural gas. The immediate system allows for service of a fleet of vehicles requiring approximately 1000 gallons per day of LNG/CNG. The system also advantageously allows both LNG and CNG to be produced and dispensed in an integrated fashion. Further, as shown in FIG. 1, the CNG dispensing location 82 and the LNG dispensing location 92 can be provided in the same public refueling station as a conventional gasoline or diesel dispensing location 100 where gasoline and diesel fuel are dispensed to vehicles via line 102. The present invention is compact enough to be enclosed in a vault underground at refueling stations to reduce land costs and increase safety.

Figure 2:
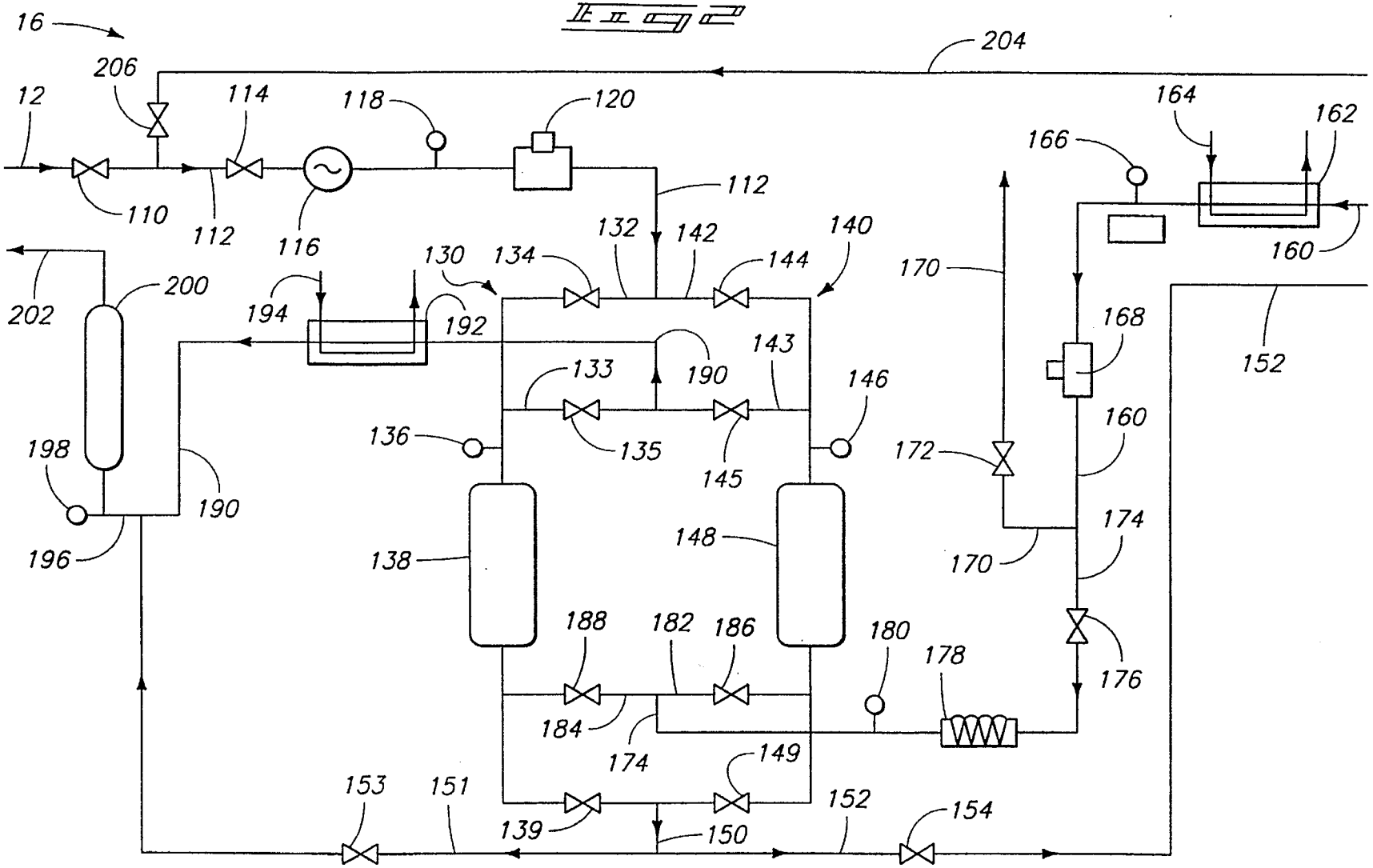
FIG. 2 is a schematic view of a purifier system used in combination with the integrated refueling system of FIG. 1.

With reference to FIG. 2, a preferred regenerative purifier system 16 is shown. The purifier system 16 removes impurities from natural gas before it enters into the fluid circuit 14 of the integrated refueling system 10 (FIG. 1 ). Typically, natural gas comprises 94% methane, 5% ethane, less than 1% propane and heavier hydrocarbons, and traces of nitrogen, carbon dioxide, water, and odorants such as methyl mercaptans and aromatics. The impurities, such as water, carbon dioxide, and the odorants, are preferably removed from the natural gas prior to liquefaction. It is to be understood, however, that the present invention could be adapted to be used in combination with nonpurified natural gas such as that generated from a landfill or waste digester.

Any suitable purification system may be utilized with the present invention. One embodiment of an adsorptive purification system 16 is shown in FIG. 2. Natural gas from a conventional preexisting natural gas pipeline is supplied via inlet 12 to the purification system 16. A flow control valve 110 regulates flow into the purifier system. The natural gas is then introduced into the purification system via line 112 which causes gas to pass serially through flow control valve 114, flow indicator 116 (e.g., a control light), pressure transducer 118 (which measures the gage pressure) and mass flow meter 120 (which measures the mass flow within line 112). The natural gas to be purified then passes to one of either line 132 or line 142, depending upon which regenerative bed (bed 138 or bed 148) is to be utilized. In one flow path, the natural gas passes through line 132, the flow of which is regulated by control valve 134, to regenerative bed 138. The bed includes a specially formulated molecular sieve material (e.g., 4A-LNG, manufactured by Union Carbide). The gas temperature within line 132 is measured by temperature transducer 136. The bed allows natural gas to flow through the sieve material (disposed within bed 138), which captures water, carbon dioxide, and methyl mercaptan within the sieve material. The purified natural gas passes to a common outlet 150, after which it may be directed to outlet line 152 which leads to the inlet line 18 of the fluid circuit 14 of FIG. 1. The flow of gas within line 152 is regulated by flow control valve 154.

If, on the other hand, it is desired use regenerative bed 148 for purification, control valve 134 is closed and control valve 144 is open which causes natural gas to flow through line 142 (the temperature of which is measured by temperature transducer 146) and into regenerative bed 148. The natural gas flows through the sieve material (disposed within bed 148), which captures water, carbon dioxide, and methyl mercaptan within the sieve material. The purified natural gas passes to a common outlet 150, after which it may be directed to outlet line 152 which leads to the inlet line 18 of the fluid circuit 14 of FIG. 1. The flow of gas within line 152 is regulated by flow control valve 154.

Regeneration of the beds can be accomplished using a supply of inert gas such as nitrogen or pure, clean natural gas. When regeneration of one of the beds 138 or 148 is desired, dry, pure natural gas may be supplied via line 160 to a heat exchanger 162. Heat exchanger 162 prewarms the natural gas within line 160 by providing a counterflow 164 of a relatively warmer counterflow material such as room-temperature water. The temperature of the resulting natural gas is measured at thermometer 166. The natural gas passes via line 160 through mass flow meter 168 and joins line 174. Optionally, natural gas passing through the flow meter 168 may be directed to an exit line 170 by opening control valve 172 and closing control valve 176. Line 174 is coupled to a control valve 176 and a heater 178 for heating the natural gas prior to regeneration of one or both beds. The temperature of the resulting natural gas is measured by thermometer 180. Gas then flows to a junction where it is directed to either line 182 or line 184, depending upon which regenerative bed is to be regenerated.

To regenerate bed 138, gas is directed via line 184 through valve 188 to cause a reverse flow through bed 138. The gas is then directed through line 133, valve 135, and to out flow line 190. The temperature of the resulting gas is relatively high (e.g., approximately 150° to 200° C.). This relatively high temperature is reduced at after-cooler 192 by causing a counterflow 194 of relatively cooler fluid to circulate around line 190. The gas then passes through line 196 and through a mercaptan removal unit 200. Waste gas then passes through outlet 202 for combustion or reinjection into a natural gas pipeline. The mercaptan could be reinjected into the CNG at the dispenser described above.

To regenerate bed 148, gas is directed via line 182 through valve 186 to cause a reverse flow through bed 148. The gas is then directed through line 143, valve 145, and to out flow line 190. The temperature of the resulting gas (which is relatively high) is reduced at after-cooler 192 by causing a counterflow 194 of relatively cooler fluid to circulate around line 190. The gas then passes through line 196 and through a mercaptan removal unit 200. Waste gas then passes through outlet 202.

To remove any foreign fluids and reactive substances (e.g., air) from the purification system 16 prior to introducing natural gas, a line 204 for supplying pressurized gaseous nitrogen is provided. Control valve 206 regulates the flow of gaseous nitrogen into the system 16. During this process, the flow of natural gas through line 12 is terminated. After the gaseous nitrogen removes any residual substances, the valve 206 is closed and natural gas then passes through the purifier system 16.

In compliance with the statute, the invention has been described in language more or less specific as to methodical features. It is to be understood, however, that the invention is not limited to the specific features described, because the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An integrated refueling system for vehicles, comprising:

an inlet for supplying natural gas to a fluid circuit;

a liquefier fluidly coupled to and forming part of the fluid circuit;

a first flow path for incoming natural gas, the first flow path including a first heat exchanger having a forward flow passageway and a counterflow passageway, wherein incoming natural gas flows through the forward flow passageway for precooling thereof, the first flow path terminating at the liquefier;

a storage reservoir fluidly coupled to the fluid circuit for containing liquefied natural gas flowing from the liquefier;

a liquefied natural gas delivery line extending from the storage reservoir to a liquefied natural gas dispensing location for dispensing liquefied natural gas to a vehicle;

a liquefied natural gas feed line fluidly coupled to the storage reservoir;

a compressor fluidly coupled to the liquefied natural gas feed line for converting relatively low pressure liquefied natural gas to relatively high pressure liquefied natural gas;

a first compressed natural gas line fluidly coupled between the compressor and the counterflow passageway of the first heat exchanger, the compressed liquefied natural gas passing through the counterflow passageway being vaporized to form compressed natural gas;

a compressed natural gas dispensing location;

a compressed natural gas dispenser line coupled between the counterflow passageway and the compressed natural gas dispensing location.

2. An integrated refueling system according to claim 1 wherein the first heat exchanger enables precooling of natural gas within the forward flow passageway by directing the liquefied natural gas through the counterflow passageway.

3. An integrated refueling system according to claim 1, further comprising a regenerative purifier system fluidly coupled to the inlet to remove impurities from the natural gas prior to liquefying natural gas.

4. An integrated refueling system according to claim 1, further comprising an expander fluidly coupled to the first heat exchanger to expand and cool the natural gas coming from the first heat exchanger.

5. An integrated refueling system according to claim 1, further comprising:

a second flow path for incoming natural gas, the second flow path including a second heat exchanger to cool incoming natural gas, the second flow path terminating at the liquefier.

6. An integrated refueling system according to claim 5 wherein the second heat exchanger enables precooling of natural gas within the forward flow passageway by the liquefied natural gas flowing in the counterflow passageway.

7. An integrated refueling system according to claim 5, further comprising:

a third flow path for passing the natural gas directly to the liquefier.

8. An integrated refueling system according to claim 1, further comprising an insulating enclosure surrounding the liquefier.

9. An integrated refueling system according to claim 1 further comprising a means for injecting an odorant into the compressed natural gas or the liquefied natural gas being dispensed.

10. An integrated refueling system according to claim 1 wherein the flow paths and natural gas lines are insulated.

11. An integrated refueling system for vehicles according to claim 1, further comprising a vapor recovery system for use in connection with the liquefied natural gas delivery station, the vapor recovery system comprising:

an insulated dispensing line to minimize heat loss as liquefied natural gas is dispensed to a vehicle;

a boil-off line to capture vapors resulting from warming of liquefied natural gas being dispensed to a vehicle;

a vapor return line coupled between the boil-off line and the liquefied natural gas storage reservoir.

12. An integrated refueling system for vehicles according to claim 1, further comprising a vapor recovery system for use in connection with the liquefied natural gas delivery station, the vapor recovery system comprising:

an insulated dispensing line to minimize heat loss as liquefied natural gas is dispensed to a vehicle;

a boil-off line to capture vapors resulting from warming of liquefied natural gas being dispensed to a vehicle;

a vapor return line coupled between the boil-off line and the inlet.

13. A refueling system for vehicles, comprising:

an inlet for supplying natural gas to a fluid circuit;

a regenerative purifier system fluidly coupled to the inlet to remove impurities from the natural gas;

a liquefier fluidly coupled to the forming part of the fluid circuit;

a first flow path for natural gas, including a first heat exchanger to initially cool the natural gas and an expander serially coupled to the first heat exchanger to expand and cool the natural gas coming from the first heat exchanger, the first flow path terminating at the liquefier;

a second flow path for natural gas, including a second heat exchanger to cool the natural gas, the second flow path terminating at the liquefier;

a third flow path for passing the natural gas directly to the liquefier;

wherein the natural gas is directed through one of the first flow path, the second flow path, or the third flow path depending upon the characteristics of the incoming natural gas or natural gas product to be produced;

a storage reservoir for containing liquefied natural gas from the liquefier;

a liquefied natural gas dispensing location fluidly coupled to the storage reservoir for dispensing liquefied natural gas;

a compressor fluidly coupled to a liquefied natural gas supply line extending from the liquefied natural gas storage reservoir;

a first compressed natural gas line for directing liquefied natural gas to the first heat exchanger for producing compressed natural gas;

a second compressed natural gas line for directing liquefied natural gas to the second heat exchanger for producing compressed natural gas;

a compressed natural gas dispensing location for dispensing the compressed natural gas.

14. An integrated refueling system for vehicles according to claim 13 wherein liquified natural gas is directed through one of the first heat exchanger or the second heat exchanger to precool incoming natural gas flowing through the first heat exchanger or the second heat exchanger prior to liquefaction.

15. An integrated refueling system for vehicles according to claim 13, further comprising an insulating enclosure surrounding the liquefier.

16. An integrated refueling system for vehicles according to claim 13 wherein the flow paths and natural gas lines are insulated.

17. An integrated refueling system for vehicles according to claim 13 wherein the liquefied natural gas dispensing location and the compressed natural gas dispensing location are combined to form a common dispensing location.

18. An integrated refueling system for vehicles according to claim 13, further comprising a vapor recovery system for use in connection with the liquefied natural gas delivery station, the vapor recovery system comprising:

an insulated dispensing line to minimize heat loss as liquefied natural gas is dispensed to a vehicle;

a boil-off line to capture vapors resulting from warming of liquefied natural gas being dispensed to a vehicle; and a vapor return line coupled between the boil-off line and the liquefied natural gas storage reservoir.

19. An integrated refueling system for vehicles according to claim 13, further comprising a vapor recovery system for use in connection with the liquefied natural gas delivery station, the vapor recovery system comprising:

an insulated dispensing line to minimize heat loss as liquefied natural gas is dispensed to a vehicle;

a boil-off line to capture vapors resulting from warming of liquefied natural gas being dispensed to a vehicle; and a vapor return line coupled between the boil-off line and the inlet.

20. An integrated refueling system for vehicles, comprising:

a first fluid circuit for liquefying natural gas, the first fluid circuit comprising a plurality of flow paths, incoming natural gas coming from a natural gas source being directed to one of the plurality of flow paths depending upon characteristics of either the incoming natural gas or the desired natural gas product, the plurality of flow paths comprising:

a liquefier;

a first incoming flow path to direct natural gas coming into the fluid circuit through a first heat exchanger/vaporizer to precool the incoming natural gas, through an expander to reduce the natural gas pressure while further cooling the gas, and into the liquefier;

a second incoming flow path to direct natural gas coming into the fluid circuit through a second heat exchanger/vaporizer to precool the incoming natural gas;

a third incoming flow path to direct the natural gas directly into the liquefier.

21. An integrated refueling system for vehicles according to claim 20 wherein liquefied natural gas is directed to one of the first heat exchanger/vaporizer or the second heat exchanger/vaporizer to precool the incoming natural gas passing through one of the first heat exchanger/vaporizer or the second heat exchanger/vaporizer prior to liquefaction.

22. An integrated refueling system for vehicles according to claim 20, further comprising:

a storage reservoir for storing liquefied natural gas;

a second fluid circuit for producing compressed natural gas for vehicle consumption, comprising:

a compressor for compressing a portion of liquefied natural gas from the storage reservoir;

a first compressed natural gas line directing liquefied natural gas from the compressor through the first heat exchanger/vaporizer to produce compressed natural gas;

a second compressed natural gas line directing liquefied natural gas from the compressor through the second heat exchanger/vaporizer to produce compressed natural gas.

23. An integrated refueling system for vehicles according to claim 22, further comprising:

a compressed natural gas supply line for directing compressed natural gas to compressed natural gas dispenser;

a buffer tank fluidly coupled to the compressed natural gas supply line for storing a supply of compressed natural gas to be directed to the compressed natural gas dispenser.

24. A method for providing a supply of compressed natural gas and liquefied natural gas to a delivery location, comprising the steps of:

providing a natural gas supply to a fluid circuit;

directing the natural gas through a first flow path, including a heat exchanger to precool the natural gas;

directing the precooled natural gas to a liquefier for liquefaction thereof;

directing the liquefied natural gas to a storage tank for storage thereof;

directing a first portion of the liquefied natural gas within the storage tank through a liquefied natural gas delivery line to a liquefied natural gas delivery location for dispensing to a vehicle;

directing a second portion of the liquefied natural gas within the storage tank through a compressor to pressurize the liquefied natural gas;

directing the natural gas from the compressor through the first heat exchanger to vaporize the pressurized, liquefied natural gas and produce compressed natural gas;

directing the compressed natural gas from the first heat exchanger through a compressed natural gas delivery line to a compressed natural gas delivery location for dispensing to a vehicle.

25. The method of claim 24, further comprising the step of directing the precooled natural gas from the heat exchanger through an expander located upstream of the liquefier to further precool the natural gas.

26. The method of claim 24, further comprising the step of directing the compressed natural gas into a compressed natural gas storage tank for supplying compressed natural gas to the compressed natural gas delivery line.

27. The method of claim 24, further comprising the steps of:

providing a boil-off line at the liquefied natural gas delivery location;

capturing vaporized natural gas caused by cooling of the liquefied natural gas dispensing line in the dispenser or a warm fuel tank;

reliquefying the captured vaporized natural gas.

28. The method of claim 24, further comprising the step of reliquefying natural gas vaporized as a result of heat leaks into the storage tank.

29. The method of claim 24, further comprising the steps of:

providing cooled, compressed natural gas at below room temperature to the compressed natural gas delivery location;

quick filling the compressed natural gas into a vehicle fuel tank so that the tank remains full after the compressed natural gas has cooled to room temperature.

30. A method for providing a supply of liquefied natural gas and compressed natural gas, comprising the steps of:

providing an incoming flow of natural gas into a fluid circuit;

directing the incoming flow of natural gas to one of a group of flow paths consisting of:

a first flow path directing the flow of natural gas through a first heat exchanger to lower the temperature of the natural gas, through an expander to further lower the temperature of the natural gas, and to a liquefier;

a second flow path directing the flow of natural gas through a second heat exchanger and then the liquefier; and a third flow path directly fluidly coupled to the liquefier; supplying liquefied natural gas to an LNG reservoir.

31. The method of 30 wherein the incoming flow of natural gas through one of the first flow path or the second flow path is precooled by liquefied natural gas.

32. The method of 30, further comprising the steps of:

directing at least part of the liquefied natural gas to a compressor for compressing the liquefied natural gas;

directing the compressed liquefied natural gas to a heat exchanger/vaporizer to produce compressed natural gas.

33. The method of claim 31 or 32, further comprising the steps of providing compressed natural gas and liquefied natural gas at an integrated delivery station for supplying both compressed natural gas and liquefied natural gas to vehicles.

34. The method of claim 33, further comprising the step of providing a vapor recovery system for vapors that are created when supplying liquefied natural gas to vehicles.

* * * * *